US005499620A

United States Patent [19]

Summers

[11] Patent Number: 5,499,620

[45] Date of Patent: Mar. 19, 1996

[54] CENTER NOCK FOR ARCHERY BOW STRING

[76] Inventor: Gregory E. Summers, 105 Overlink Ct., Lynchburg, Va.

[21] Appl. No.: 383,496

[22] Filed: Feb. 3, 1995

[51] Int. Cl.[6] ..... F41B 5/18

[52] U.S. Cl. ..... 124/91; 124/35.2

[58] Field of Search ..... 124/35.2, 90, 91

[56] References Cited

U.S. PATENT DOCUMENTS

| | | | |
|---|---|---|---|
| 2,189,707 | 1/1958 | Kayfes et al. . | |
| 2,905,166 | 9/1959 | Niemeyer | 124/91 |
| 3,847,133 | 11/1974 | Awiszus | 124/91 |
| 4,086,904 | 5/1978 | Suski et al. | 124/90 |
| 4,134,369 | 1/1979 | Cook | 124/35.2 |
| 4,151,825 | 5/1979 | Cook | 124/35.2 |
| 4,509,497 | 4/1985 | Garvison | 124/35.2 |
| 4,539,968 | 9/1985 | Garvison | 124/35.2 |
| 4,656,994 | 4/1987 | Jenks . | |
| 4,791,908 | 12/1988 | Pellis | 124/35.2 |
| 4,909,233 | 3/1990 | Stephenson | 124/91 |
| 4,926,835 | 5/1990 | Peck | 124/35.2 |
| 4,930,485 | 6/1990 | Kopper | 124/91 |
| 4,981,128 | 1/1991 | Garvison | 124/35.2 |
| 5,016,603 | 5/1991 | Tentler | 124/91 |
| 5,020,508 | 6/1991 | Greene, Jr. | 124/35.2 |
| 5,170,772 | 12/1992 | Hamm | 124/35.2 |
| 5,247,921 | 9/1993 | Todd | 124/35.2 |
| 5,361,747 | 11/1994 | Laabs | 124/91 |

OTHER PUBLICATIONS

"Package" entitled Ultra–Nok, made by QAD Inc., Lynchburg, Virginia.

*Primary Examiner*—John A. Ricci
*Attorney, Agent, or Firm*—Nixon & Vanderhye

[57] ABSTRACT

A center nock for a bow string of an archery bow includes a substantially C-shaped body portion having spaced ends extending substantially linearly therefrom. The ends are formed with first respectively axially aligned half groove portions adapted for engagement with the bow string. A cross support bar is secured to the spaced ends, the support bar including second respectively aligned half groove portions which cooperate with the first respectively aligned groove portions to form a pair of closed apertures fully encircling the bow string.

17 Claims, 4 Drawing Sheets

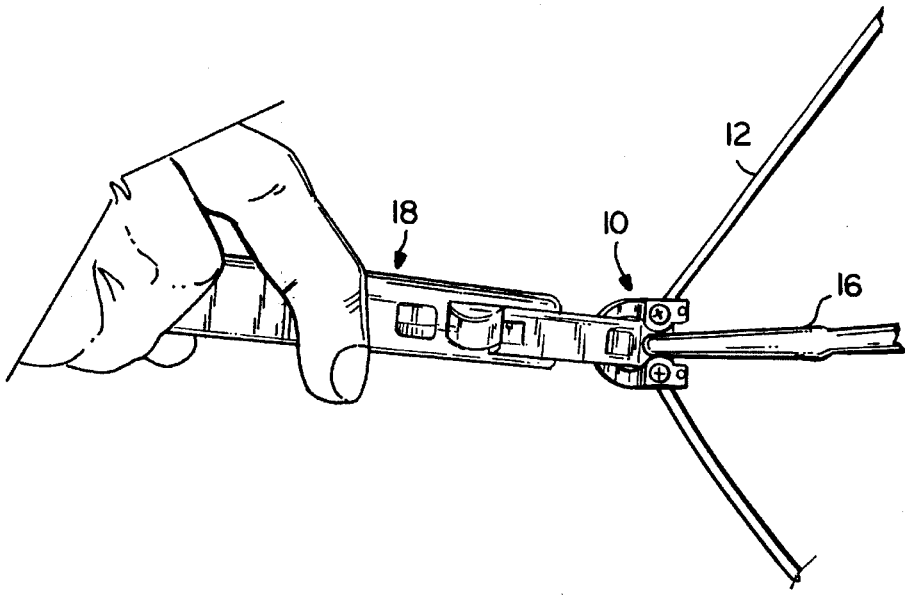
*Fig. 1*
*Fig. 2*
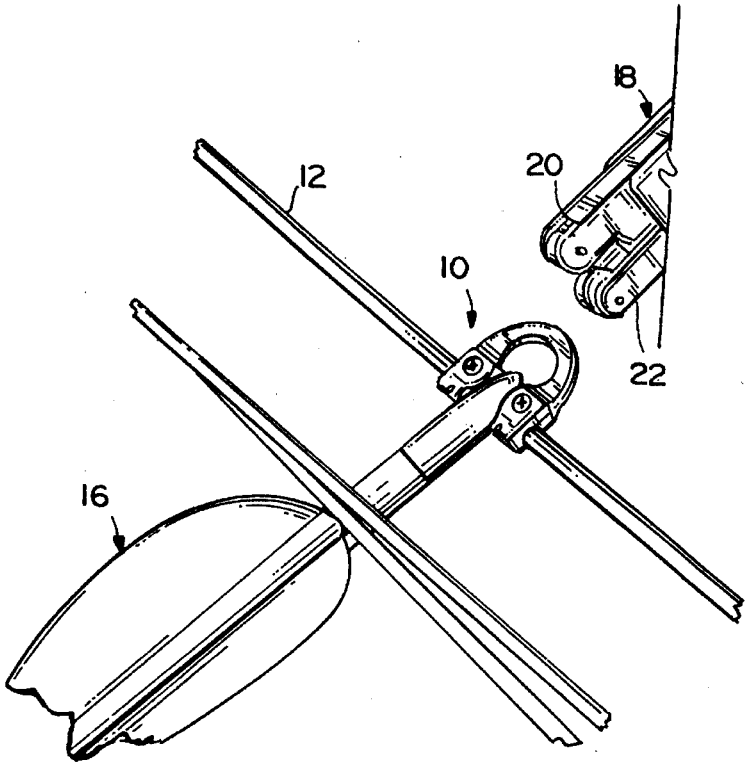

CENTER NOCK FOR ARCHERY BOW STRING

This invention relates generally to archery bows, and particularly to a new and improved center nock for attachment to the bow string.

BACKGROUND OF THE INVENTION

In the field of archery, it is conventional for an arrow to be provided with a string engaging fork, also known as an arrow nock, at the rear end of the arrow. It is also known to provide a bow string hock which locates the arrow nock on the bow string to facilitate good aim of the arrow. Accordingly, the bow string nock must be located on the bow string substantially at the center of the string and substantiality horizontally aligned with the point at which the forward end of the arrow is supported at the center of the bow. Representative bow string hocks are described, for example, in U.S. Pat. Nos. 5,361,747; 4,909,233; and 2,905,166.

It is also known to provide various forms of hand held gripping and firing devices designed to cooperate with a bow string nock that enable an archer to apply a strong pull to the bow string and to release the arrow without having to grip the end of the arrow and the bow string with the fingers. See, for example, U.S. Pat. Nos. 5,016,603 and 4,930,485. U.S. Pat. No. 4,930,485 discloses a half loop shaped center nock having two ends attached to the bow string, in combination with a bow string drawing device which includes a releasable draw pin that engages the half loop portion of the nock. The drawing device also includes a trigger designed to release the bow string upon operation of the trigger. Other release devices are described in U.S. Pat. Nos. 5,247,921; 5,170,772; 5,020,508 and 4,926,835.

SUMMARY OF THE INVENTION

In accordance with an exemplary embodiment of this invention, there is provided a new and improved bow string center nock which includes a substantially C-shaped loop (also referred to herein as the nock body) having extended legs provided with axially aligned half grooves adapted to receive the bow string. The legs also have fastener holes adjacent their free ends, and locating pins on the other side of the half grooves from the fastener holes. A cross support bar has offset bosses at opposite ends thereof, each boss having a fastener hole, an alignment pin locating hole, and a complementary half groove. The cross support bar is securable across the gap between the extended legs of the nock body by screws or other suitable fasteners passing through the aligned fastener holes. At the same time, the locating pins provided on the extended legs are receivable within the corresponding pin alignment holes in the cross support bar.

The offset nature of the cross support bar bosses and the manner of fitment with the nock legs, insures that the web portion of the cross support bar is co-planar with the C-shaped loop. When the cross support bar is in place, the complementary half grooves combine to completely enclose and pinch the bow string at spaced locations along the extended legs of the nock.

The center nock with cross support bar in accordance with this invention provides the following distinct advantages over prior center nock devices:

(1) The two piece pin/lock clamp system securely fastens the nock to the bow string.

(2) The cross bar support design eliminates width compression/distortion of the nock body at full draw.

(3) The cross support bar eliminates string sag during arrow propulsion.

(4) The center line of pull is directly behind the center line of the bow string, eliminating twisting action during propulsion and after release.

(5) The two piece construction provides quick, easy installation and adjustment.

(6) The center nock is adapted to work with most if not all conventional trigger devices including caliper, roller, and ball bearing designs.

(7) The two pieces of the center nock in accordance with this invention are formed and machined from aircraft aluminum, resulting in reduced weight and increased arrow speed.

(8) Incorporation of the cross bar support insures that alignment of the release aid attachment is always correct after the arrow is nocked.

In accordance with the broader aspects of the invention, therefore, I have provided a center nock for a bow string of an archery bow; the center nock comprising a substantially C-shaped body portion having spaced ends extending substantially linearly therefrom, the ends formed with first respectively axially aligned half groove portions adapted for engagement with the bow string; and a cross support bar secured to the spaced ends, the support bar including second respectively aligned half groove portions which cooperate with the first respectively aligned groove portions to form a pair of closed apertures fully encircling the bow string.

In accordance with another aspect, I have provided a bow and arrow system which includes a bow, a bow string and an arrow having an arrow nock located at a rearward end of the arrow, the improvement comprising a bow string center nock adapted for cooperative engagement with the arrow nock, the center nock comprising a substantially C-shaped body portion having spaced ends extending substantially linearly therefrom., the ends formed with first respectively axially aligned half groove portions adapted for engagement with the bow string; and a cross support bar extending transversely of the spaced ends and secured to the spaced ends, the support bar including second respectively aligned half groove portions which cooperate with the first respectively aligned groove portions to form a pair of closed apertures fully encircling the bow string.

Other objects and advantages of the invention will become apparent from the detailed description which follows.

BRIEF DESCRIPTION OF THE DRAWINGS

FIG. 1 is a partial perspective of a bow string at full draw incorporating a bow string center hock in accordance with this invention, and shown in engagement with a release aid device;

FIG. 2 is a partial perspective similar to claim 1 but illustrating the release aid device disengaged from the bow string center nock;

DETAILED DESCRIPTION OF THE DRAWINGS

Figure 3:
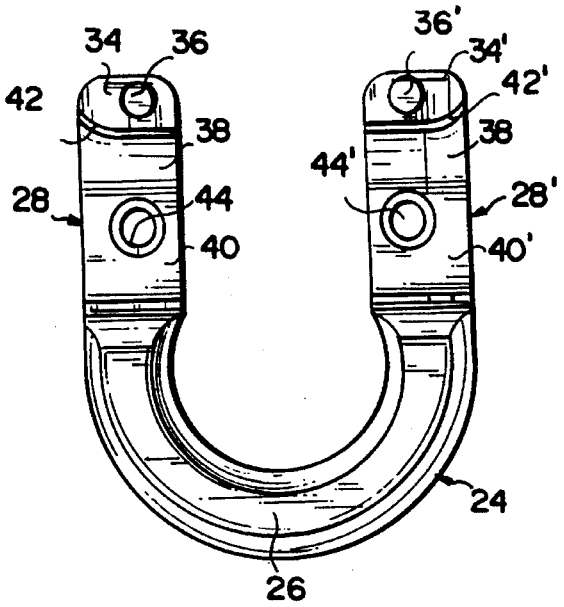
FIG. 3 is a side elevation of the center nock in accordance with this invention, with the cross support bar removed.

With reference initially to FIG. 1, the nock 10 in accordance with this invention is shown in place on a bow string 12, with the tail end 14 of an arrow 16 in place, straddled by the nock. A conventional release or firing device is shown at 18 engaged with the nock 10 and, as best seen in FIG. 2, the "jaws" 20, 22 of the device 18 are designed to grip the nock 10 in a conventional manner.

Figure 4:
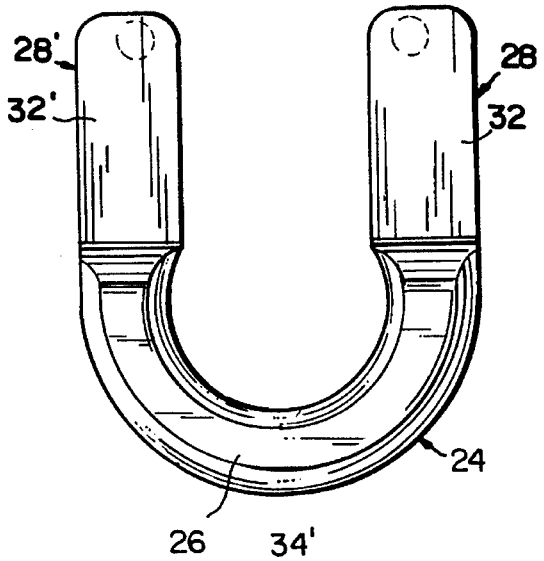
FIG. 4 is an opposite side elevation of the center nock illustrated in FIG. 3.
Figure 5:
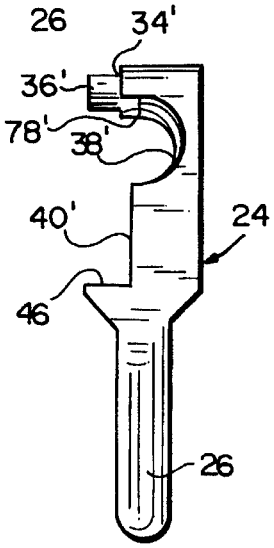
FIG. 5 is an end view of the center nock illustrated in FIG. 4.

The nock 10 is itself shown more clearly in FIGS. 3–9 and includes a C-shaped body portion 24. In this regard, the nock body as shown in FIGS. 3 and 4 is normally oriented 90° from the position shown in FIGS. 3 and 4 when installed on an otherwise vertically oriented bow string as can be appreciated from FIG. 1. The hock body includes a smoothly curved half loop 26, with axial legs or extensions 28, 28' extending from opposite ends of the loop. Since the legs 28, 28' are identical, only one (leg 28) will be described in detail. For convenience, corresponding elements of leg 28'are designated with similar reference numerals with a "prime" symbol added. In addition, reference to an "outside" surface indicates a surface facing away from a cross support bar 30 (described in detail further herein) secured across the free ends of the legs 28, 28') and reference to an "inside" surface indicates a surface facing towards the cross support bar 30.

Leg 28 has an outside flat surface 32 (FIG. 4) extending between the free end of the substantially linearly extending leg and the loop 26. Leg 28 also has a first inside flat surface 34 (FIG. 3) with a pin 36 projecting therefrom adjacent the free end of the leg. A bow string half groove 38 is formed across the leg 28 between the first inside flat surface 34 and a second inside flat surface 40. The half groove 38 includes a flared end 42 where the string enters or exits the nock, and against which the string is pressed when the string is pulled back to a firing position. A threaded hole 44 is formed in the leg 28, opening on a second flat surface portion 40. The hole 44 is generally aligned with and parallel to, the pin 36. In other words, the pin 36 and hole 44 are on opposite sides of the half groove 38 which extends in a direction perpendicular to both the pin 36 and hole 44, transversely of the leg 28.

It should be noted that pins 36 and 36', half groove 38, 38'and holes 44, 44'are aligned as best seen in FIG. 3, the reasons for which will become apparent below. It will be appreciated in any event that the bow string 12 will extend along the axially aligned half grooves 38, 38'as also explained in greater detail below. Right angle surface 46 (FIG. 5) intersects surface 40 and provides an abutment surface for the cross support bar 30 as also explained further below.

Turning to FIGS. 6 through 9, a cross support bar 30 is illustrated which includes a pair of integral bosses 48, 48'connected by a cross piece or web 50. Again, since the bosses 48 and 48' are identical, only one (boss 48) will be described in detail here. Initially, it is to be understood that the cross piece 50 has the appearance of being attached to one side of the bosses, but it is in fact integrally formed. As viewed in FIG. 9, the cross piece includes an outside surface 52 which is substantially in the same plane as the inside surface 54 of the boss 48, and an inside surface 56 which is displaced from the boss 48 by the thickness of the cross piece or web 50.

Figure 6:
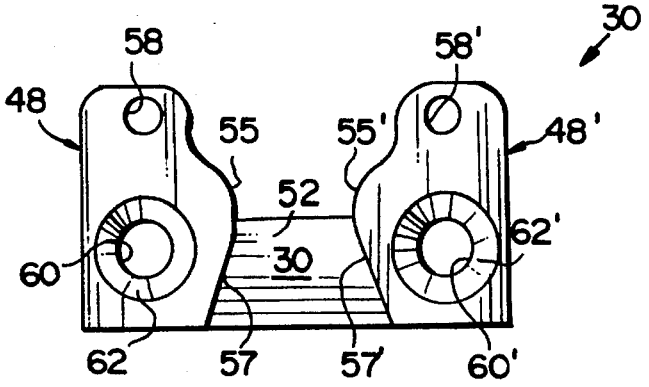
FIG. 6 is a side elevation of a cross support bar for use with the center nook body illustrated in FIGS. 3, 4 and 5.

As best seen in FIG. 6, the radiused surface 55 and flared liner surface 59, when combined with similar opposing surfaces 55', 59'provide ample space for the arrow nock which straddles the cross piece or web 50. These surfaces also allow for some angular movement of the arrow nock during placement and pull of the arrow so as to insure the desired horizontal alignment of the arrow.

The boss 48 has a pair of holes 58, 60 formed therein, located so as to align respectively with pin 36 and threaded hole 44 in the leg 28. Hole 60 is countersunk at 62 to receive the tapered head of a screw 76 shown only in FIG. 10.

Figure 7:
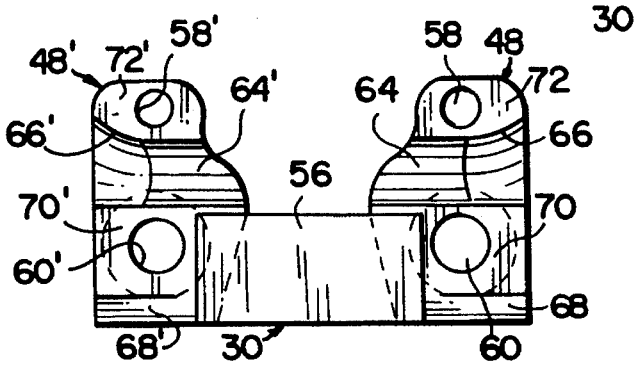
FIG. 7 is an opposite side elevation of the cross support bar shown in FIG. 6.
Figure 8:
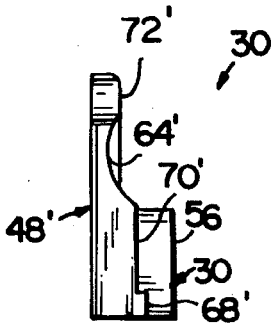
FIG. 8 is an end elevation of the cross support bar shown in FIG. 7.
Figure 9:
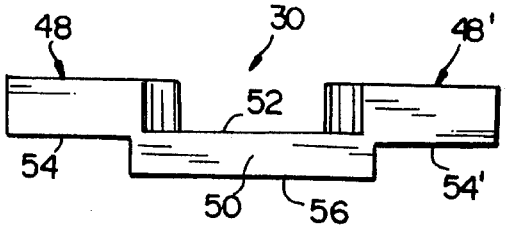
FIG. 9 is a front elevation of the cross support bar illustrated in FIG. 6.
Figure 10A:
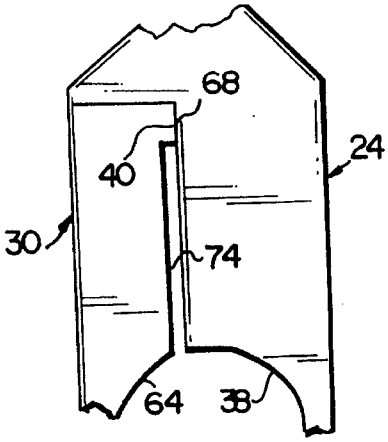
FIG. 10A is an enlarged detail taken from FIG. 10 and showing a portion of the interface between the nock body portion and the cross support bar.

With specific reference to FIG. 7, the inside of boss 48 is also formed with a transverse half groove 64, flared at 66, and located to align with half groove 38 in leg 28. The inside of boss 48 is also provided with an edge portion (or ledge) 68 (see also FIG. 8) raised slightly relative to inside flat surface 70. At the same time, surface 70 is raised relative to inside flat surface 72 on the other side of half groove 64. Referring back to FIG. 5, it will be seen that the flat surface 34' of the leg 28' extends slightly beyond flat surface 40' so that when the cross support bar 30 is assembled to the nock body 24, flush engagement occurs along surfaces 68, 68' and 40, 40', and also along surfaces 72, 72' and 34, 34'. As a result, a slight gap 74 is created along part of the interface, as best shown in FIG. 10A. This arrangement allows the cross support bar to flex about the ledges 68, 68' and to close the gap 70, depending on the string size, when the screws 76, 76' are tightened.

Figure 10:
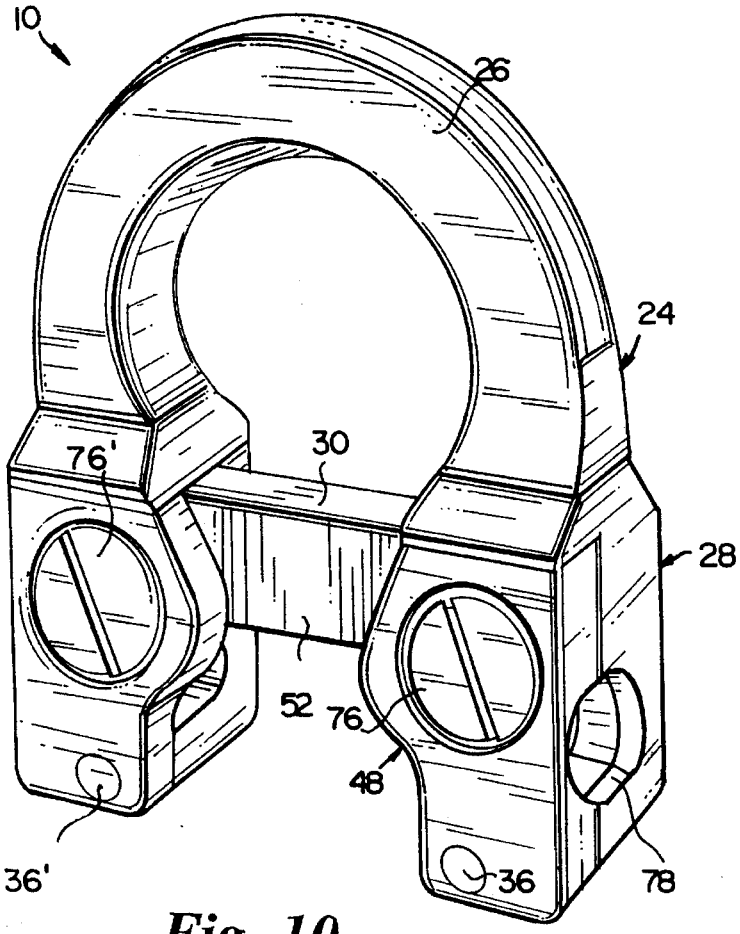
FIG. 10 is a perspective view of the assembled center nock in accordance with this invention.

The cross bar support 30 is assembled to the nock body 24 by aligning pins 36 and 36' with holes 58 and 58', and by aligning fastener holes 44, 44' with holes 60 and 60'. The support may then be pressed into place with the cross piece 50 fitting snugly between the legs 28 and 28'. Screws 76, 76' are used to secure the cross support bar 30 in place (as best seen in FIG. 10) via holes 44, 44' and 60 60'. Of course, prior to assembly, the bow string 12 will first be seated within the half grooves 38 and 38' in the legs 28, 28', respectively, and complementary half grooves 64 and 64' serve to create two closed periphery apertures through which the bow string passes. From FIGS. 5 and 10, it can also be seen that the closed periphery is not round but, rather, includes at least one "flat" 78. The non-round configuration of the string receiving grooves tends to pinch the string 12 and keep the nock 10 securely in place.

By offsetting the cross-piece 52 from bosses 48, 48' as described above, the cross-piece 52 is located in the same plane as the half loop 26, when the cross bar support 46 is assembled as shown in FIG. 10. With this arrangement, the arrow nock which straddles the cross piece or web 50 remains in direct alignment with the half loop 26 which is to be engaged by the jaws of the release or firing mechanism 18.

It is also within the scope of this invention to extend the legs 28, 28' as necessary to provide additional space between cross piece 50 and a release or firing mechanism adapted to engage the half loop 26. In this way, virtually all conventional firing or release aids can be used with the center nock 10 of this invention. Similarly, the space between legs 28 and 28' can be increased to accommodate larger diameter arrow nocks.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A center nock for a bow string of an archery bow; the center nock comprising:

a substantially C-shaped body portion having spaced ends extending substantially linearly therefrom, said ends formed with first respectively axially aligned half groove portions adapted for engagement with the bow string; and a cross support bar secured to said spaced ends, said support bar including second respectively aligned half groove portions which cooperate with said first respectively aligned groove portions to form a pair of closed apertures fully encircling the bow string.

2. The center nock of claim 1 wherein said spaced ends and said cross support bar are provided with respectively aligned fastener holes.

3. The center nock of claim 2 wherein said spaced ends and said cross support bar are also provided with cooperating locating means for facilitating assembly of said cross support bar to said body portion.

4. The center nock of claim 3 wherein said locating means comprises a pair of pins and a pair of holes aligned to receive, respectively, one each of said pair of pins.

5. The center nock of claim 1 wherein said spaced ends are at least partially offset laterally from said substantially C-shaped body portion.

6. The center nock of claim 5 wherein said cross-support bar comprises a pair of bosses connected by a cross piece, and wherein said cross piece is substantially co-planar with said substantially C-shaped body portion.

7. The center nock of claim 6 wherein said cross piece is sized and located to be received within a slot formed in an arrow nock provided at a rear end of an arrow.

8. The center nock of claim 1 wherein said closed apertures each have non-round configuration adapted to pinch the bow string.

9. In a bow and arrow system which includes a bow, a bow string and an arrow having an arrow nock located at a rearward end of the arrow, the improvement comprising a bow string center nock adapted for cooperative engagement with the arrow nock, said center nock comprising:

a substantially C-shaped body portion having spaced ends extending substantially linearly therefrom, said ends formed with first respectively axially aligned half groove portions adapted for engagement with the bow string; and a cross support bar extending transversely of said spaced ends and secured to said spaced ends, said support bar including second respectively aligned half groove portions which cooperate with said first respectively aligned groove portions to form a pair of closed apertures fully encircling the bow string.

10. The center nock of claim 9 wherein said spaced ends and said cross support bar are provided with respectively aligned fastener holes.

11. The center nock of claim 10 wherein said spaced ends and said cross support bar are also provided with cooperating locating means for facilitating assembly of said cross support bar to said body portion.

12. The center nock of claim 11 wherein said locating means comprises a pair of pins and a pair of holes aligned to receive, respectively, one each of said pair of pins.

13. The center nock of claim 9 wherein said spaced ends are at least partially offset laterally from said substantially C-shaped body portion.

14. The center nock of claim 13 wherein said cross-support bar comprises a pair of bosses connected by a cross piece, and wherein said cross piece is substantially co-planar with said substantially C-shaped body portion.

15. The center nock of claim 14 wherein said cross piece is sized and located to be received within a slot formed in an arrow nock provided at a rear end of an arrow.

16. The center nock of claim 9 wherein said closed apertures each have a non-round configuration adapted to pinch the bow string.

17. The center nock of claim 9 in combination with a firing mechanism adapted to grip the C-shaped body portion.

* * * * *